United States Patent [19]

Lind

[11] 4,397,226

[45] Aug. 9, 1983

[54] METHOD AND DEVICE FOR EXTRACTING CONTAMINATED AIR BY SUCTION

[76] Inventor: Leif I. Lind, Burevägen 5, 182 63 Djursholm, Sweden

[21] Appl. No.: 229,572

[22] PCT Filed: May 20, 1980

[86] PCT No.: PCT/SE80/00147

§ 371 Date: Jan. 13, 1981

§ 102(e) Date: Jan. 13, 1981

[87] PCT Pub. No.: WO80/02518

PCT Pub. Date: Nov. 27, 1980

[30] Foreign Application Priority Data

May 21, 1979 [SE] Sweden ..... 7904443

[51] Int. Cl.[3] ..... F24F 11/00

[52] U.S. Cl. ..... 98/115 R; 98/38 R; 417/174

[58] Field of Search ..... 98/38 E, 38 F, 38 A, 98/38 R, 115 LH, 115 SB, 115 R; 126/299 D, 299 E; 417/174

[56] References Cited

U.S. PATENT DOCUMENTS 3,221,635 12/1965 Hill, Jr. ..... 126/299 E
3,621,104 11/1971 Sofia et al. ..... 98/115 R X
3,994,210 11/1976 Davis ..... 98/115 R
4,002,110 1/1977 Teodorescu et al. ..... 98/43 R
4,038,912 8/1977 Kuechler ..... 126/299 D
4,085,736 4/1978 Kuechler ..... 126/299 D

FOREIGN PATENT DOCUMENTS 7611472 8/1979 Sweden .

*Primary Examiner*—William E. Tapolcai
*Attorney, Agent, or Firm*—Fleit, Jacobson & Cohn

[57] ABSTRACT

In a method of removing contaminated air by suction, ejector air is blown towards a tangentially directed inlet slot (3) in a cylinder (2*a*) comprising part of an air extractor (1). The contaminated air is entrained in this way to form a rotating air stream in the interior of the cylinder, said air stream also being imparted an axial movement component as a result of underpressure prevailing in the interior of the cylinder. The cyclone effect of the air stream in the cylinder is used to separate contaminated particles from the air and to deposit the particles on the inside of the cylinder. The air stream can also be caused to pass through a cylindrical filter (11) arranged centrally in the cylinder (2*a*). Blow-openings (8) for ejector air are suitably located in the vicinity of the end of a tangentially directed cylinder-extension portion (2*b*). The cylinder can be flushed to remove adhering particles therefrom, e.g. by means of a nozzle which is arranged in the slot (3) and which delivers a tangentially directed stream of liquid.

11 Claims, 11 Drawing Figures

METHOD AND DEVICE FOR EXTRACTING CONTAMINATED AIR BY SUCTION

The present invention relates generally to a method of extracting contaminated air by suction, and to an extractor for carrying out the method. Extractors for this purpose find a wide field of use. For example, they can be used in domestic kitchens, in field kitchens and industrial kitchens; in laboratories, and in different industrial applications, such as for extracting impure air from spray booths, and from the vicinity of work benches at which harmful substances are given off; in plants where dust-laden goods are transported and handled; and in connection with metal baths which give off harmful vapours; and within the process industry etc.

Previously known extractors normally comprise a hood which permits effective capture of the contaminated air. Normally, the air is conveyed from the extractor through a system of passages, by means of an extractor fan.

When the air contaminants have the form of particles or aerosols, it is desirable, and in many cases necessary, to filter the air after extraction, in order to prevent clogging of the said passage system and to prevent said contaminants from being discharged to atmosphere.

In extractors of the aforementioned kind, the speed at which the air is captured decreases inversely proportional to the square of the distance to the suction opening. At a distance of one diameter from a circular suction opening, the speed of the air seen in an axial direction will have fallen to about 8% of the speed of said air at the suction opening.

In the case of processes which result in the contamination of the surrounding air and which, at the same time, produce heat, the extractors may include so-called overhead hoods which are located above the source of contamination, whereat the thermal lifting force of the air is utilized to facilitate the extraction thereof. Since the surrounding air is admixed with the upwardly approaching contaminating air, the cross-sectional area of the air flow will increase with an increase in distance from the contaminating source.

An empirical formula often used in these connections states that the overhang of the hood above the contaminating source shall correspond to approximately $\frac{1}{3}$ the distance from said source. Known extractors which include overhead hoods therefore require a lot of space.

A further, serious problem connected with overhead hoods is that the contaminated air often passes the breathing zone of a person present in the vicinity of the contaminating source, before the air reaches the suction opening.

One example of a known suction extractor comprising a large and bulky overhead hood is described and illustrated in the U.S. Pat. No. 3,221,635 (Hill). This patent can be said to describe a method of removing contaminated air by suction, in which the impure air is drawn tangentially into a cylinder via an inlet gap or slot. In the interior of the cylinder, the air stream is caused to rotate and, by applying an underpressure, is given an axially directed movement and led away from the cylinder. The effective use of this apparatus also relies on the thermal lifting force of the heated air, i.e. the apparatus can not, for example, be used for extracting contaminated gases by suction from a spray booth or the like where no rising air currents occur.

The Swedish published specification 76 11472-7 (publication number 409.178) describes an air extractor which operates on the suction principle but in which the contaminated air is not caused to pass an inlet gap and, as a rule, is not imparted a rotary movement having an axial movement component. The extractor according to this patent, however, requires a relatively large installation space.

The object of the present invention is to provide a method and an extractor for removing contaminated air by suction, which reduces or eliminates the disadvantages of known methods and extractors.

In its widest aspect the method according to the invention is mainly characterised in that ejector air is blown towards the inlet gap or slot in a manner such as to entrain impurified air therewith and to admix said air with the air stream rotating in the cylinder.

When applying the method according to the invention, the entrained, contaminated air stream is caused to rotate at high speed within the cylinder. The cyclone effect thus produced is used for separating particulate contaminants from the air stream and for depositing said contaminants onto the inner surfaces of the cylinder. Consequently, the method according to the invention functions equally as effectively, irrespective of whether the entrained, contaminated air is heated or not. Further, the method permits the extractor cylinder and the blow openings through which ejector air is blown to be placed in the desired location, depending on the circumstances. Thus, the ejector air may either have a vertical or a horizontal direction, or may have any desired direction relative to the horizontal or vertical plane.

For the purpose of filtering the air flowing through the cylinder, the cylinder may be provided with a filter, preferably a cylindrical filter, arranged centrally in the cylinder. Subsequent to passing the filter, the air flow will, in many cases, have lost a major part of its rotary movement component, i.e. the air stream will move substantially in an axial direction after passing the filter. A cylindrical filter presents a substantially larger filter surface than does a flat filter, which is the normal form of filter used in air extractors of the kind mentioned.

A particular advantage afforded by a filter arrangement of the kind mentioned is that the aforementioned cyclone effect cause particles of grease, fat and the like to be deposited on the inner surfaces of the cylinder, so that said particles do not clog or dirty the filter, thus extending the service life of the filter, before needing to be changed and cleaned. Further, if desired, the filter may comprise an activated carbon such as to absorb obnoxious and/or harmful gases in the air stream, which has been purified of fat particles and the like. These particles of fat or grease would otherwise clog the carbon filter and rapidly make it ineffective.

The outlet opening from the cylinder may be located in the centre of, e.g., one of the end walls of the cylinder. As a result of the rotary movement of the air within the cylinder, there is obtained a uniform suction speed in the suction slot, even if the cylinder is relatively long. In the case of bench-working locales, large kitchens and the like, the cylinder is placed in a horizontal position, suitably against a wall and approximately at head-height over the working place in question. In this case, the suction slot is suitably located adjacent the wall, so that the contaminated air is caused to move in a direction away from the breathing zone of the workman in question.

When the cylinder is placed horizontally, with the inlet slot arranged adjacent a wall, or adjacent a vertical extension of the wall of the cylinder (as hereinafter described) tangentially into the cylinder-the blow-openings are located adjacent said wall or said cylinder-wall extension. The ejector air is then suitably blown along the wall or the extended part of said cylinder wall, which provides for good stability and a favourable flow direction of the entrained contaminated air.

For reducing the extent to which air present on the sides of the cylinder is entrained into the cylinder by the ejector air, and to prevent the occurrency undesirable, disturbing air streams in said locale, the cylinder is suitably provided with side walls. Tests have shown that these walls should be so formed that, when the cylinder is positioned horizontally, the leading edge of the walls extends obliquely upwardly from the blow-openings to the opposite peripheral portion of the cylinder at the wall of the ejector.

In order to obtain the best purifying effect from the extractor, it is preferred, when applying the method of the invention, that the width of the inlet slot is adjusted in dependence on the underpressure in the cylinder. It is often sufficient to adjust the width of said slot when trimming and balancing the extractor for a given locale. It is preferred, however, that the gap-setting means can be activated from outside the cylinder, to enable the slot width to be readily adjusted, or finely adjusted, when required by existing circumstances.

When applying the method of the invention, a tangentially directed stream of liquid can be injected into the slot, for flushing away contaminating particles adhering to the inner wall of the cylinder. The contaminated liquid is then carried away through drainage means arranged in the cylinder. When the cylinder is to be positioned horizontally, a drainage pipe is suitably arranged at the bottom of the cylinder.

Although the cleaning liquid can be continuously fed to the cylinder, it is preferred that the supply of said liquid is effected intermittently. Thus, for example, such a cylinder-cleaning operation can be automatically initiated when the extractor is switched off, i.e. at the end of a working day.

Alternatively, contaminants can be removed from the cylinder, for example, via a drainage opening provided with a closure valve and arranged in one end wall of the extractor.

One further advantage is that when a filter is arranged in the extractor, said filter can be flushed from one side, without it being necessary to remove the filter from the cylinder. This greatly facilitates cleaning of the filter, which is otherwise particularly troublesome, for example, in large kitchens, restaurants and the like.

When the blow-openings have the form of ejector slots, the air blown from said slots obtains an angle of propagation of about 15° from the wall or the cylinder-wall extension. It is therefore important that the impulse of the applied ejector air, the distance between ejector and inlet slot and the diameter of the suction cylinder are given optimal values.

It has been found that the diameter of the cylinder should correspond to or exceed half the distance between the ejector slots and the suction slots. The magnitude of the ejector flow is dependent on the speed at which the air is blown out and the distance to the suction slot.

The invention also relates to an air extractor whose essential characterizing features are disclosed in the accompanying claims.

Further aspects of the invention will be evident from the following description, which is made with reference to the accompanying drawings and which schematically illustrate a number of embodiments of the invention. In the Figures, corresponding elements have been identified by the same references.

FIG. 1 is a front view of the extractor and FIG. 2 is a sectional side view thereof with the side walls removed. FIGS. 3 and 4 show the air extractor with the side walls attached thereto, from different directions and in perspective.

FIG. 5 is a perspective view of the extractor with one side wall removed, FIG. 6 is a cut-away front view of the extractor and FIG. 7 is a side sectional view through the extractor.

FIGS. 1–4 illustrate the principal embodiment of an air extractor 1 for removing contaminated air by suction. The extractor is intended to co-act with an underpressure-generated means (not shown), such as a suction fan, for drawing contaminated air into the extractor.

The air extractor 1 comprises a hollow cylinder having a wall **2*a* which merges with a tangentially directed cylinder-wall extension 2*b*. Between the inner end of the cylinder wall 2*a* and the extension 2*b* there is located an inlet slot 3** through which air is drawn tangentially into the cylinder.

Adjacent the end of the cylinder-wall extension **2*b* is an air-supply passage 7 having outwardly directed blow-openings 8, through which streams of air are blown towards the slot 3**, said air streams entraining contaminated air therewith.

Figure 1:
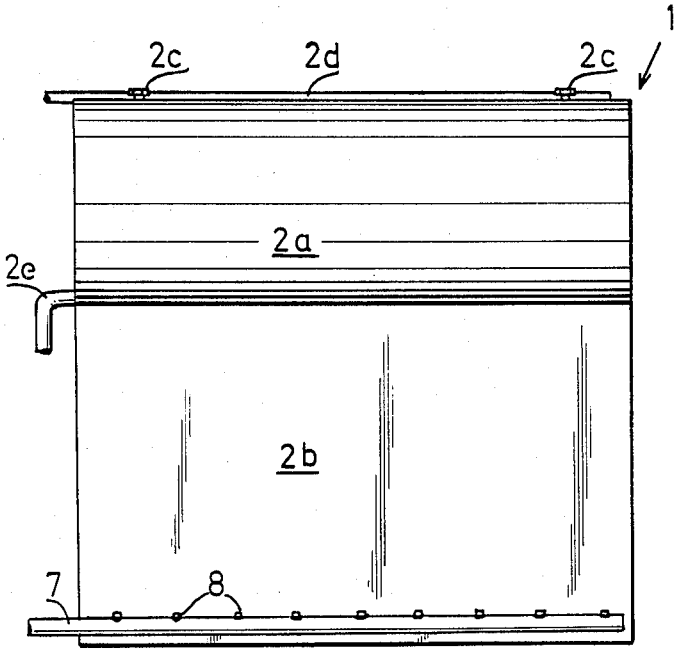
FIGS. 1–4 illustrate the principle embodiment of an air extractor according to the invention, whereat
Figure 2:
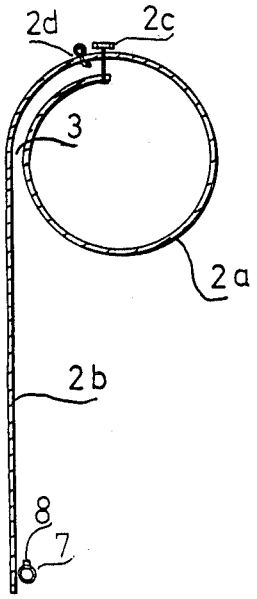
Figure 3:
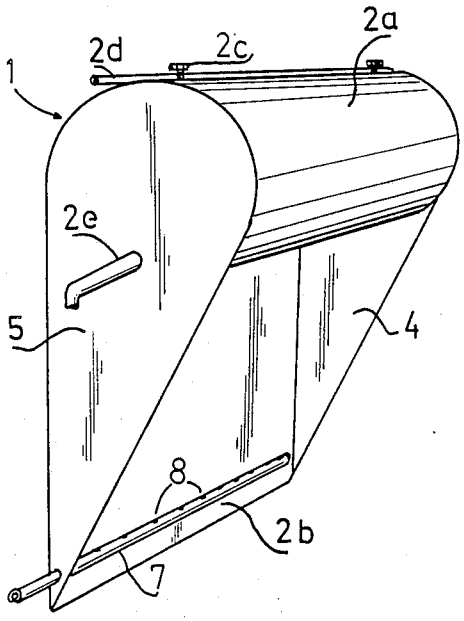
Figure 4:
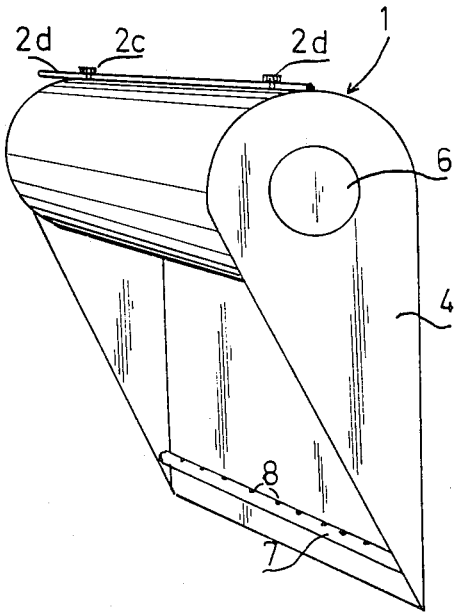

In FIGS. 3 and 4 the air extractor is shown to be provided with side walls 4 and 5, of which one wall, namely 4, exhibits an axially directed discharge opening 6, which, in practice, is suitably connected to a discharge passage.

As contaminated air enters the extractor, said air is imparted a rotary movement, and the cyclone effect herewith produced is utilized in separating contaminating particles from the air flow, said particles being deposited on the inside of the cylinder. The incoming air flow then departs in an axial direction through the discharge passage 6.

The width of the inlet slot 3 can be adjusted by means of screws **2*c* accessible from outside the cylinder wall 2*a***.

The reference **2*d* identifies a means for spraying or injecting a stream of liquid tangentially into the slot 3. Said means may have the form of a liquid-supply pipe having a plurality of tangentially directed nozzles arranged in said slot. Arranged at the bottom of the cylinder is a drainage pipe 2*e***, for conducting away contaminated liquid.

Figure 6:
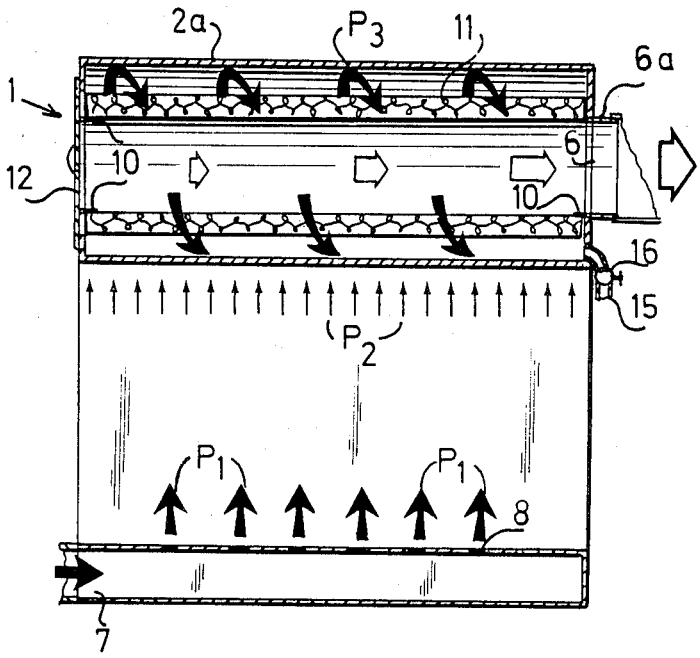
FIGS. 5–7 illustrate a modified embodiment, inter alia provided with a cylindrical filter. Thus.
Figure 7:
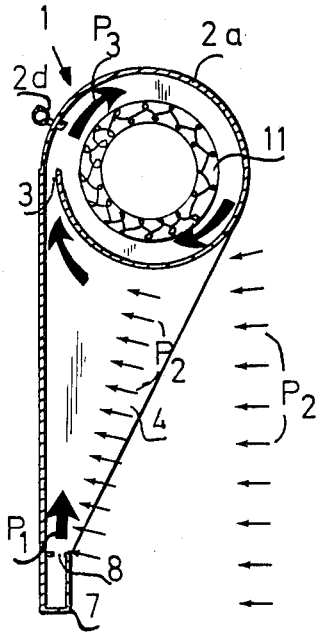
Figure 5:
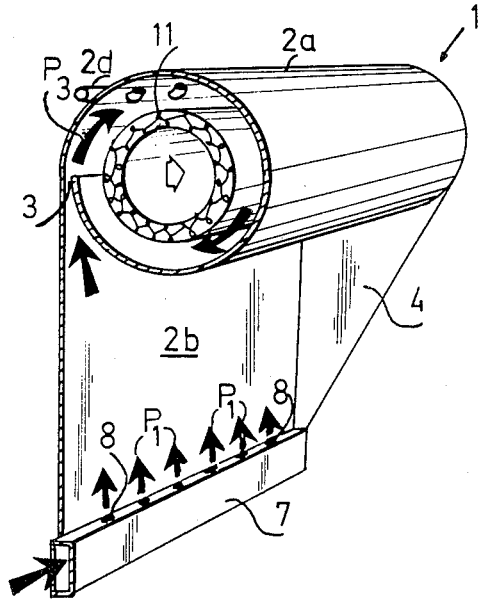

FIGS. 5–7 illustrate an example of a modified air extractor. The pattern of air flow is illustrated in the different Figures by means of arrows, whereat the arrows $P_1$ identify the air streams blown out from the air-supply passage 7; the thinner arrows $P_2$ identify the entrained contaminated air; and the arrows $P_3$ within the cylinder identify the total air flow rotating in the cylinder.

In this embodiment there is provided a cylindrical filter 11 which is located within the cylinder and which is arranged to be gradually through-passed by the rotating air flow when it has lost the major part of its energy of rotation, whereat the contaminating particles are deposited on the filter. The purified air flow then passes axially to the discharge passage 6*a* through the opening 6. The filter 11 is carried by holder means 10 arranged in the cylinder. The end of the cylinder opposite the opening 6 is covered by a removable cover 12, which can be readily removed to enable the filter located within the cylinder to be cleaned.

The filter 11 may suitably comprise activated carbon. Since particles of fat or grease present in the contaminated air are deposited, as a result of the cyclone effect, on the inside of the cylinder wall, said particles will not clog or dirty the filter, thereby leaving the filter in a condition in which it is fully capable of cleansing the entrained contaminated air of gases present therein.

Cleaning liquid may also, in this embodiment, be introduced into the cylinder through the suction slot 3, for the purpose of cleaning the interior of said cylinder. Contaminants taken up by the liquid can be flushed out via a drainage pipe 15 provided with a closure valve 16 in the cylinder end-wall in which the discharge opening 6 is arranged.

In the illustrated embodiment, the supply passage 7 for ejector air comprises a bent part of the cylinder-wall extension 2*b*. Ejector air is supplied by means of a fan not shown. The blow-openings 8 comprises openings arranged in a wall of the passage 7. These openings 8 may, optionally, merge with one another to form a slot (not shown). It will be understood that ejector air can be supplied and blown out in other ways than those illustrated in FIGS. 5–7.

Experiments have shown that the diameter of the cylinder should exceed half the distance between the openings 8 and the inlet slot 3. In addition, the side walls should have the form of the side wall 4 illustrated in FIGS. 5 and 7.

Figure 8:
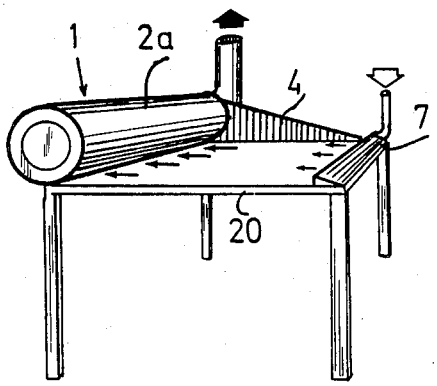
FIGS. 8–11 are perspective views illustrating a number of different ways in which an air extractor according to the invention can be used.

FIGS. 8–11 illustrate further examples of applications of the invention. Thus, FIG. 8 illustrates a working table 20 at which activities may take place which result in contamination of the surroundings, e.g. such activities as welding, brazing, the cleansing of dust-laden articles and equivalent working operations. The air extractor 1 is, in this case, placed horizontally at one end of the table, whereat the upper surface of the table itself forms a restricting wall which contributes to conducting impurified air into the inlet slot 3.

Arranged at the other end of the table is a supply passage 7 having openings arranged therein and being intended for blowing towards the slot streams of air which entrain therewith contaminated air at the central part of the table.

Figure 9:
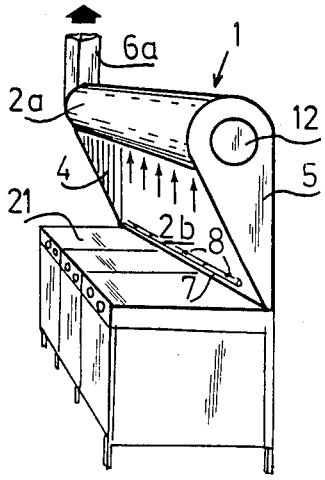

FIG. 9 illustrates a practical application of the air extractor shown in FIGS. 1–4 in a large kitchen, whereat the actual length of the extractor 1 corresponds to the distance covered by a plurality of mutually adjacent cookers 21. This embodiment exemplifies the use of the extractor over a contaminating source having a heated surface, in which case the thermal rising force of the impurified air can be used, whereat the blow-openings for ejector air can normally be smaller than in other cases.

Figure 10:
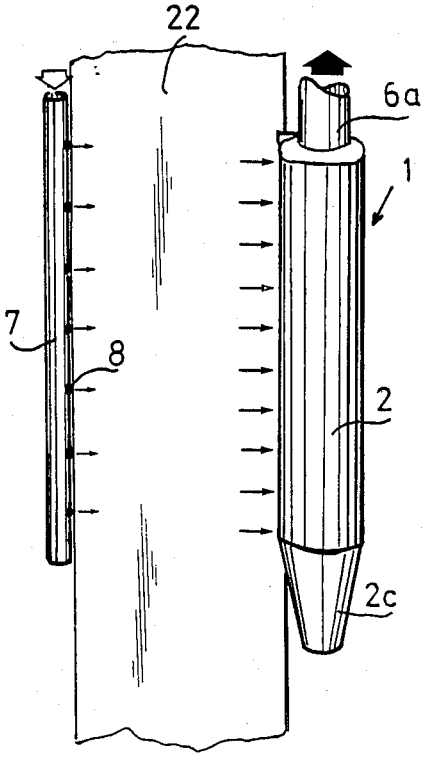

FIG. 10 illustrates a vertical arrangement of an air extractor having a corresponding supply passage for blowing out entrainment air. The arrangement can also be used in many different connections, as exemplified by a newspaper-line 22 illustrated in FIG. 10, from which it is desired to remove surplus solvent applied during a printing operation.

A similar vertical arrangement may be used, for example, when vertically transporting different kinds of dust-laden or particle-laden substances.

The lower part 2*c* of the air extractor is of conical configuration and serves to collect the contaminating particles dispersed as the air stream rotates. Thus, the process can be considered to correspond to a cyclone separation process. The purified air flow is discharged upwardly via the connected passage 6*a*.

Figure 11:
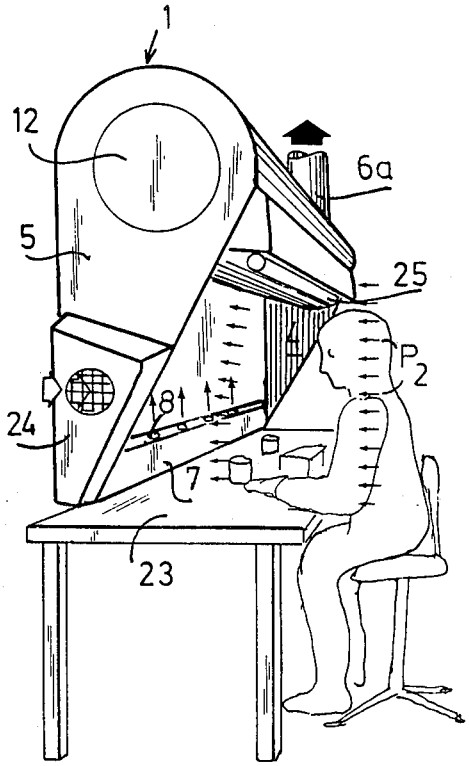

FIG. 11 illustrates the application of an air extractor 1 at a working site having a table surface 23 which, for example, may comprise the bottom surface of a fume cupboard or the like. Adjacent the side wall 5 of the extractor is a fan housing 24 which accommodates a fan for supplying air to a supply pipe 7 having upwardly facing blow-openings 8 arranged therein. The Figure illustrates how a fluorescent tube can be mounted adjacent the extractor, for effectively illuminating the working area without risk of the tube being dirted to any appreciable extent by the contaminated air. The entrained fresh air, here symbolized by the arrows $P_2$, passing the tube 25 contributes, in this respect, to prevent dirtying of the tube to any great extent.

The aforedescribed examples of the modes of use of the method according to the invention and the extractor for carrying out the method will show that the invention can be applied in many different connections, whereat particularly effective suction can be created, despite the fact that the extractor itself is of a very simple design and has but small dimensions. Even though in all the illustrated embodiments the air stream is discharged axially from one end of the extractor, it will be understood, particularly in the case of relatively long extractors, that in certain cases it may be convenient to provide both ends of the extractor and/or intermediate parts thereof with discharge openings 6 connected to one or more discharge lines 6*a*. The fact that the air extractor has a given axial length enables contaminated air to be removed by suction in a uniform and steady stream, without the formation of eddy-currents externally of the extractor. When using a cylindrical filter in the air extractor an additional important advantage is provided in relation to known air extractors having flat filters, namely that the rotary air stream provides for uniform distribution of the contaminated particles on the filter, thereby enabling the greatest possible filter area to be used, this area being great in relation to the total space required by the air extractor.

I claim:

1. An air extractor for removing contaminated air by suction and arranged to co-act with an air suction device, said extractor comprising: a hollow cylinder having a peripherally arranged inlet slot for directing contaminated air tangentially into said cylinder, said contaminated air forming part of an air stream imparted a rotary movement having an axially directed movement component within said cylinder; discharge means for leading said air stream away from said cylinder; ejector blow-openings arranged opposite said inlet slot for blowing streams of air towards said slot, said streams entraining there with contaminated air, and carrying said air to the air stream rotating in the cylinder; and a tangentially directed wall extension which merges with a wall of said hollow cylinder in the region of said inlet slot and extends to said ejector blow openings, said tangentially directed wall extension contributing to leading the contaminated air into said inlet slot.

2. An extractor according to claim 1, characterised in that the cylinder is provided with means for mounting a cylindrical filter therein.

3. An extractor according to claim 1, wherein the rotary movement of said contaminated air causes contaminating particles to adhere to the inside of the cylinder; and further comprising spray means located in the inlet slot for delivering a tangentially directed stream of liquid to the interior of said cylinder, said stream of liquid being arranged to remove and entrain therewith said contaminating particles adhering to the inside of the cylinder; and drainage means for conducting contaminated liquid away from the cylinder.

4. An extractor according to claim 1, further comprising walls provided at the ends of the hollow cylinder, whose leading edges extend obliquely from the region of said blow-openings to the peripheral portion of the hollow cylinder located adjacent said inlet slot.

5. An air extractor for removing contaminated air by suction and arranged to co-act with an air suction device, said extractor comprising: a hollow cylinder having a peripherally arranged inlet slot for directing contaminated air tangentially into said cylinder, said contaminated air forming part of an air stream within said cylinder imparted a rotary movement having an axially directed movement component; discharge means for leading said air stream away from said cylinder; and ejector blow-openings arranged opposite said inlet slot for blowing streams of air towards said slot, said streams entraining there with contaminated air, and carrying said air to the air stream rotating in the cylinder; and adjustment means accessible from outside the cylinder for regulating the size of the inlet slot.

6. A method of removing contaminated air having contaminants, the method comprising the steps of:

entraining contaminated air in a flow of ejector air directed towards an inlet slot provided at the periphery of a generally hollow cylindrical fixture, said generally hollow cylindrical fixture having a wall thereof in the region of the inlet slot merging with a tangentially directed wall extension which extends from the wall of the cylindrical fixture to a source of the ejector air and contributes to leading the contaminated air into said slot;

causing mixed ejector and contaminated air to pass through said inlet slot into said hollow cylindrical fixture, the introduction of said mixed air into said hollow cylindrical fixture through said inlet slot causing the mixed air to rotate within said cylindrical fixture in order to impart centrifugal force to the contaminants; and withdrawing the rotating mixed air stream axially from the hollow cylindrical fixture.

7. A method according to claim 6, wherein the rotation of the mixed air within said hollow cylindrical fixture creates a cyclone effect causing the contaminants to be separated and deposited around an inner surface of said hollow cylindrical fixture.

8. A method according to claim 6, further comprising the step of filtering the mixed air as it moves through the hollow cylindrical fixture.

9. A method according to claim 6, wherein said flow of ejector air is provided by an air ejector having blow openings directed toward said inlet slot.

10. A method according to claim 1, further comprising the steps of:

flushing contaminants from the inner surface of the hollow cylindrical fixture; and draining the contaminants from the hollow cylindrical fixture.

11. A method of removing contaminated air having contaminants, the method comprising the steps of:

entraining contaminated air in a flow of ejector air directed towards an inlet slot provided at the periphery of a generally hollow cylindrical fixture;

causing mixed ejector and contaminated air to pass through said inlet slot into said hollow cylindrical fixture, the introduction of said mixed air into said hollow cylindrical fixture through said inlet slot causing the mixed air to rotate within said cylindrical fixture in order to impart centrifugal force to the contaminants;

withdrawing the rotating mixed air stream axially from the hollow cylindrical fixture; and adjusting the size of the inlet slot in order to maintain a desired underpressure within the hollow cylindrical fixture.

* * * * *